United States Patent [19]

Schley

[11] Patent Number: 4,699,127

[45] Date of Patent: Oct. 13, 1987

[54] BACK MASSAGE AND SCRUBBING DEVICE

[76] Inventor: Scott W. Schley, 1491 Sandio Dr., Port Saint Lucie, Fla. 33452

[21] Appl. No.: 799,578

[22] Filed: Nov. 19, 1985

[51] Int. Cl.[4] ..... A61H 7/00

[52] U.S. Cl. ..... 128/62 R; 128/65; 4/606

[58] Field of Search ..... 128/62 R, 65; 4/606, 4/605, 559

[56] References Cited

U.S. PATENT DOCUMENTS

| | | | |
|---|---|---|---|
| 1,833,426 | 11/1931 | Knudson | 128/62 R |
| 2,485,899 | 10/1949 | McBreen | 128/62 R |
| 3,289,215 | 12/1966 | Kennedy | 4/606 |
| 3,478,369 | 11/1969 | Ensley | 4/606 |
| 3,577,985 | 5/1971 | Guffin | 128/62 R |
| 3,612,044 | 10/1971 | Gurrola | 4/559 |
| 3,896,796 | 7/1975 | Soderblom | 128/65 |
| 4,003,372 | 1/1977 | Willoby | 128/65 |
| 4,037,591 | 7/1977 | Sarno | 128/65 |
| 4,040,132 | 8/1977 | Braun | 4/606 |
| 4,076,876 | 2/1978 | Bowles | 128/60 |
| 4,187,575 | 2/1980 | Collins | 128/65 |
| 4,417,362 | 11/1983 | Walker | 4/605 |

FOREIGN PATENT DOCUMENTS

| | | | |
|---|---|---|---|
| 0154935 | 9/1985 | European Pat. Off. | 128/65 |
| 460820 | 2/1937 | United Kingdom | 128/62 R |

*Primary Examiner*—Edgar S. Burr
*Assistant Examiner*—Tonya Lamb
*Attorney, Agent, or Firm*—Scrivener and Clarke

[57] ABSTRACT

A massaging and scrubbing device for the human back consists of a closed cell foam plastic base member of relatively high density and rigidity and a layer of closed cell foam plastic sheet material adhered to the base member. The sheet material has a mildly abrasive exposed surface and high compressibility and flexibility so that all recesses on a human back are engaged by the sheet as the back is moved back and forth while pressed against the device. The device can be used with or without soap and water applied thereto depending on whether one wants only a massage or a combined back scrub and massage.

8 Claims, 8 Drawing Figures

BACK MASSAGE AND SCRUBBING DEVICE

This invention relates to personal grooming devices and more particularly to a device for massaging and scrubbing the back of a human user.

As everyone is well aware, scrubbing or massaging one's back by oneself can be difficult. Brushes with long handles and flexible, somewhat abrasive straps for drawing back-and-forth over the back are available but they require a certain amount of manual dexterity and only a small area of the back can be treated at a time. Further, neither can serve as a massage device.

The object of the present invention is to provide a device for massaging and scrubbing the entire back and which can be adjustably mounted in a desired position against a rigid support, such as a vertical wall, for engagement for the user's back as it is moved back and forth across the slightly abrasive surface of the device to massage the back and, after application of soap and water to the surface of the device, to scrub the back.

Other objects and their attendant advantages will become apparent as the following detailed description is read in conjunction with the accompanying drawings wherein.

Figure 1:
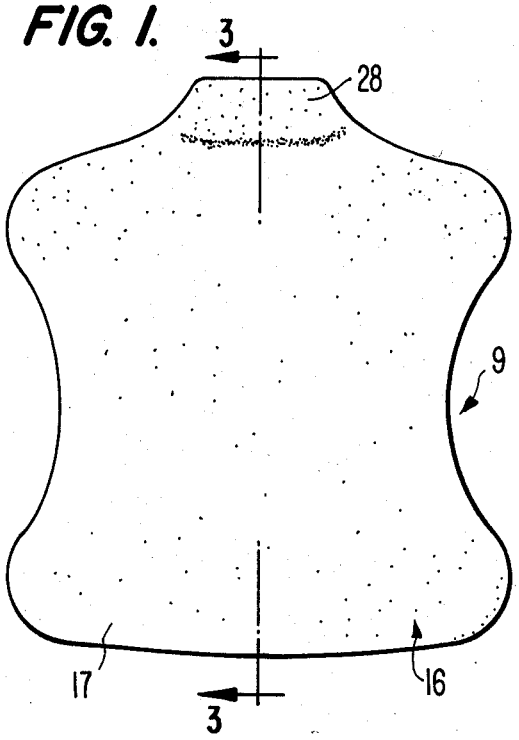
FIG. 1 is a front plan view of a back massage and scrubbing device constructed in accordance with the present invention.
Figure 2:
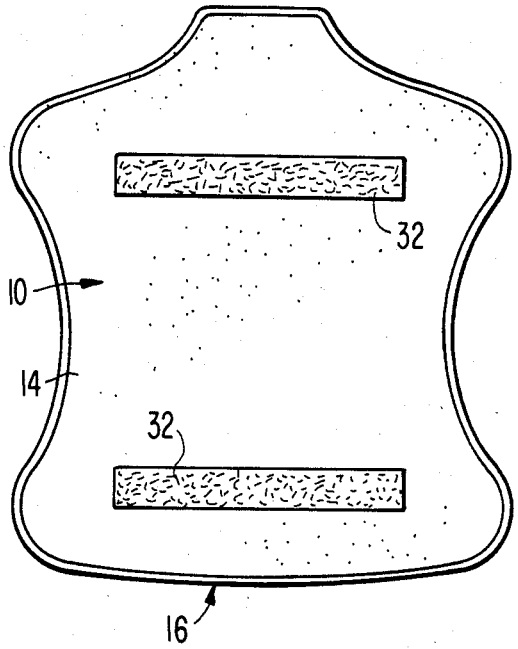
FIG. 2 is a rear plan view of the device of FIG. 1.

Referring now to the drawings, the back massage and scrubbing device 9 of the invention comprises a base member 10 of closed cell foam, one suitable material being polyethylene foam manufactured by The Dow Chemical Company under the trademark ETHAFOAM. The base member has a front face 12 and a rear face 14 and has sufficient rigidity to prevent it from buckling or substantially yielding when a user's back presses the member against a rigid support such as the wall 11 shown in FIG. 5. The base member may have a thickness on the order of about 2 inches and vertical and horizontal dimensions giving the member a size and configuration conforming it substantially to those of an average human back.

Figure 4:
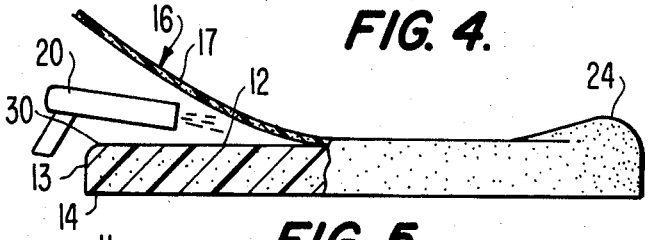
FIG. 4 is a partly schematic, partly sectional view showing a method of adhering a sheet of flexible plastic material to a plastic base member.
Figure 3:
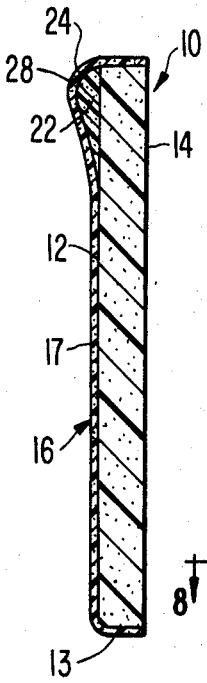
FIG. 3 is a vertical cross sectional view taken substantially on the line 3—3 of FIG. 1.

Adhered to at least the front face 12 and side walls 13 of the base member 10 is a relatively thin, flexible, compressable sheet 16 of closed cell foam plastic, one suitable material being polyethylene anti-static sheet foam manufactured and sold by The Dow Chemical Company under the trademark ETHAFOAM 221. The sheet material is uniformly adhered to the front face 12 and also the sides 13 of the base member 10 in any one of a variety of ways known in the art, one particularly desirable method being by the application of heat from a blower-heater 20, similar to a hair dryer, simultaneously to the confronting surfaces of the sheet and base member as shown in FIG. 4.

Prior to the application of the sheet 16, a tapered block 22 of the same material as the base member, and having a rounded upper end 24 may be adhered to the upper end of the base member with the sheet 16 being adhered over the block as it is adhered over the remainder of the base member to provide the device with a protruding and upstanding neck-engaging part 28. The front or outer side edges of the base member are rounded as shown at 30 in FIG. 4 throughout the periphery of the base member except in the region of the block 22.

The purpose of the sheet 16 is that it not only provides a suitable slightly abrasive surface 17, as more fully described below, but the sheet has a relatively high degree of compressibility relative to the base member whereby the sheet yields slightly to conform to the irregularities of the back as it is moved back and forth over the device during massaging or scrubbing. Thus the effect on the back is soothing yet comfortable, stimulating, and complete whereas similar motion across the much less yielding surface of the base member, without the sheet thereover is scratchy, uncomfortable, incomplete and decidedly not soothing.

Figure 6:
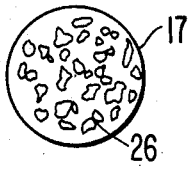
FIG. 6 is an enlarged detailed view of a representative section of a slightly abrasive surface on the massage and scrubbing surface of the device.
Figure 7:
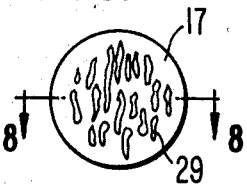
FIG. 7 is an enlarged view similar to FIG. 6 of an alternative abrasive surface.
Figure 8:
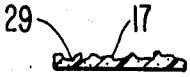
FIG. 8 is a vertical cross sectional view taken substantially on the line 8—8 of FIG. 7.

The mildly abrasive surface of the sheet material is provided naturally in one of two ways during manufacture of the sheet material, the essence of the surface being a series of shallow pits randomly disposed over the entire surface of the exposed face of the sheet with shallow protuberances disposed between the pits. FIG. 6 is an enlarged view of one type of surface wherein the pits are defined by irregularly shaped shallow recesses 26, the protuberances being defined by the portions of the surface not occupied by the recesses. In FIG. 7 the pits and protuberances are defined by more-or-less parallel striations 29 on the surface of the sheet, the striations defining a surface having a mildly abrasive texture as seen in FIG. 8 and across which the user moves his back when the device is fixed in its position of use against a substantially vertical support such as the wall 11 shown in FIG. 5.

Figure 5:
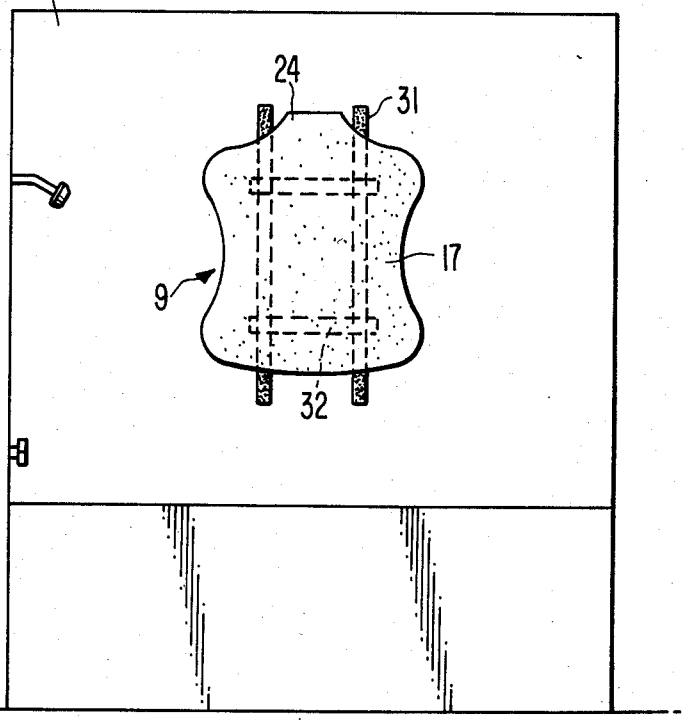
FIG. 5 is a view showing the invention mounted in one position of possible use.

Though the device of the invention may be mounted in a position of use in a variety of ways, a preferred mounting means comprise male or female strips of Velcro 31 which may be adhered to the wall 11 in a shower stall, as in FIG. 5, with complementory strips 32 adhered to the rear face of the base member 10 at right angles to the strips 31. Thus the device may be adjustably but securely fixed to a solid surface in a position best suited to the height of the individual using the device.

In use, for straight massage purposes, the device is mounted at a height suited to the user and he merely rubs his bare back back-and-forth across the surface of the sheet 16. Because the sheet yields, all portions of the user's back are treated to the massage action with no portions not being reached due to bridging by the message surface of anatomical back recesses, as would be the case were one to move his back across the denser, more unyielding surface of the base member. For scrubbing purposes, the user first wets the surface and then applies soap to the surface after which he moves his back in opposite directions across the surface thereby treating his back to a cleansing action at the same time as he treats it to a soothing massage action. Because closed cell foam plastic is used throughout, only the surfaces of the device becomes wetted and no water is absorbed by the plastic. Thus it is always in readiness for use by a succession of persons.

From the foregoing description it will be seen that the invention is susceptible to changes and modifications without however, departing from the spirit and scope of the appended claims.

What is claimed is:

1. A back massage and scrubbing device comprising a closed cell foam plastic base member having side edges of a selected height, a front face and a rear face which is co-extensive with said front face and planar throughout its extent, said planar rear face being directly engageable with a support surface, said base member having sufficient rigidity to prevent said member from buckling when the pressure force of a user's back is exerted thereagainst, a layer of closed cell flexible and compressible foam plastic sheet material of less thickness than the height of the side edges of said base member uniformly adhered to at least the front face of said base member, said flexible foam plastic sheet material having an exposed face characterized by shallow pits disposed over the entire surface of said exposed face with shallow protuberances being disposed between said pits, said pits and protuberances together defining an abrasive surface by which a user's back pressed against said surface may be scrubbed and massaged without discomfort during relative movement between said surface and said back, and said base member includes a protruding and upstanding neck engaging part over which said flexible foam plastic sheet material extends.

2. The back massage and scrubbing device of claim 1, wherein said pits and protruberances are defined by substantially vertically extending striations.

3. The back massage and scrubbing device of claim 1, wherein said pits are defined by irregularly shaped, randomly disposed shallow recesses, said protuberances being defined by the portions of the surface of said face not occupied by said recesses.

4. The massage and scrubbing device of claim 1, wherein said plastic is polyethylene.

5. The massage and scrubbing device of claim 1, wherein said base member has a size and configuration conforming substantially to those of the back of an average human.

6. The massage and scrubbing device of claim 1, wherein the flexibility and compressibility of said sheet material is selected so that it yields sufficiently to enable all recesses in a user'back to be engaged by the sheet material during movement of said back relative to said device and while said back and device are pressed together.

7. The back massage and scrubbing device of claim 1, including means for releasably mounting said device in a substantially immovable position for engagement by a user's back.

8. The massage and scrubbing device of claim 7, wherein the releasable mounting means comprises at least one of male and female Velcro members carried on the rear face of said base member for cooperating with the other of said Velcro members which is adapted to be fixed to a rigid support surface in a position to be engaged by said one of said members on the rear face of said base member.

* * * * *